US010611140B2

(12) United States Patent
Takeuchi et al.

(10) Patent No.: US 10,611,140 B2
(45) Date of Patent: Apr. 7, 2020

(54) INKJET PRINTING APPARATUS

(71) Applicant: CANON KABUSHIKI KAISHA, Tokyo (JP)

(72) Inventors: Toshiki Takeuchi, Tokyo (JP); Masahiro Sugimoto, Yokohama (JP); Ippei Tsushima, Kawasaki (JP); Kohei Fukui, Hachioji (JP); Masato Izumi, Tokyo (JP); Ryosuke Sato, Kawasaki (JP); Kenji Sugiyama, Kawasaki (JP); Kengo Nieda, Kawasaki (JP); Kota Uchida, Kawasaki (JP); Yuichiro Yanagi, Funabashi (JP); Yusuke Nakaya, Inagi (JP); Atsushi Sakamoto, Yokohama (JP); Susumu Hirosawa, Tokyo (JP); Takeshi Murase, Yokohama (JP); Futoshi Hirose, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/015,364

(22) Filed: Jun. 22, 2018

(65) Prior Publication Data

US 2019/0001662 A1 Jan. 3, 2019

(30) Foreign Application Priority Data

Jun. 29, 2017 (JP) ..... 2017-127833

(51) Int. Cl.
*B41J 2/01* (2006.01)
*B41J 2/005* (2006.01)

(52) U.S. Cl.
CPC ..... *B41J 2/0057* (2013.01); *B41J 2002/012* (2013.01)

(58) Field of Classification Search
CPC ..... B41J 2/0057; B41J 2002/012
See application file for complete search history.

(56) References Cited

U.S. PATENT DOCUMENTS 6,682,189 B2 1/2004 May et al.
2005/0110856 A1 5/2005 Mouri et al.
(Continued)

FOREIGN PATENT DOCUMENTS

CN 102294894 A 12/2011
CN 104661825 A 5/2015
(Continued)

OTHER PUBLICATIONS

European Search Report issued in corresponding European Application No. 18175105.8 dated Jan. 4, 2019.
(Continued)

*Primary Examiner* — Huan H Tran
(74) *Attorney, Agent, or Firm* — Venable LLP

(57) ABSTRACT

A printing apparatus according to an embodiment of this invention brings, out of a cleaning unit that cleans a transfer member in contact with a transfer member and an application unit that applies a reactive liquid with ink to the transfer member, the cleaning unit into contact with the transfer member to clean the transfer member by the cleaning unit at the start of the printing operation. Alternatively, out of the application unit and an absorbing unit that absorbs a liquid component from the reactive liquid applied by the application unit in contact with the transfer member, the printing apparatus brings the application unit into contact with the transfer member to apply the reactive liquid by the application unit.

15 Claims, 13 Drawing Sheets

(56) References Cited

U.S. PATENT DOCUMENTS

| | | | | |
|---|---|---|---|---|
| 2008/0043082 | A1* | 2/2008 | Yahiro | B41J 2/0057 347/103 |
| 2009/0073222 | A1 | 3/2009 | Hori | |
| 2009/0317555 | A1 | 12/2009 | Hori | |
| 2011/0234729 | A1 | 9/2011 | Noguchi | |
| 2011/0316913 | A1 | 12/2011 | Kaiho et al. | |
| 2012/0127250 | A1 | 5/2012 | Kanasugi et al. | |
| 2015/0097906 | A1 | 4/2015 | Beier | |

FOREIGN PATENT DOCUMENTS

| | | | |
|---|---|---|---|
| DE | 10245066 | A1 | 4/2003 |
| DE | 102012023389 | A1 | 12/2013 |
| JP | H05-330036 | A | 12/1993 |
| JP | 2003182064 | A | 7/2003 |
| JP | 2005-170036 | A | 6/2005 |
| JP | 2009-072928 | A | 4/2009 |
| JP | 2010-005502 | A | 1/2010 |
| JP | 2016-120625 | A | 7/2016 |
| KR | 10-2012-0053954 | A | 5/2012 |

OTHER PUBLICATIONS

Copending, unpublished U.S. Appl. No. 16/015,370 to Yuichiro Yanagi et al., filed Jun. 22, 2018.

Copending, unpublished U.S. Appl. No. 16/030,114 to Kenji Sugiyama et al., filed Jul. 9, 2018.

Office Action dated Nov. 15, 2019, in Chinese Application No. 201810642652.3.

* cited by examiner

INKJET PRINTING APPARATUS

BACKGROUND OF THE INVENTION

Field of the Invention

The present invention relates to an inkjet printing apparatus, and particularly to, for example, an inkjet printing apparatus that transfers an image formed by discharging ink to an intermediate transfer member to a print medium and prints the image.

Description of the Related Art

Conventionally, printing apparatuses that perform printing in accordance with an inkjet method includes a printing apparatus configured to discharge ink to an intermediate drum by a printhead, form an image on the intermediate drum, transfer the image to a print medium, and print the image. For example, Japanese Patent Laid-Open No. 2003-182064 discloses an arrangement that includes an image forming unit using an inkjet printhead (to be referred to as a printhead hereinafter), a liquid collection unit, a transfer processing unit, and the like around an intermediate transfer member (also simply referred to as a transfer member) such as the intermediate drum.

More specifically, the image is formed by discharging the ink to the transfer member by the printhead, then an extra liquid is collected and removed from the formed image by rotating the transfer member, after that, the formed image is heated, the transfer member is further rotated, and the image is transferred to the print medium at a transfer position. After the image transfer, the transfer member further rotates to clean remaining ink, recovering the state of the transfer member for next image formation.

There is also known an arrangement that performs preprocessing for applying a liquid known as a preprocessing liquid (or a reactive liquid) to the transfer member in order to improve the quality of an image to be formed next in the recovering process.

In the related art disclosed in Japanese Patent Laid-Open No. 2003-182064, the sequence timing of contact of respective constituent elements (the image forming unit, the liquid collection unit, a heating unit, the transfer processing unit, a cleaning unit, a preprocessing unit, and the like) that involve in a printing operation to a transfer member at the start/stop of the printing operation is not described. However, unless a contact sequence and a separation sequence of the respective constituent elements with respect to the transfer member are maintained appropriately, the following problem arises, making it impossible to perform satisfactory printing.

(1) At Start of Printing Operation

A case in which the contact sequence of the cleaning unit→the preprocessing unit is not maintained Dust/a foreign substance sticking to the transfer member is trapped in the preprocessing unit that applies a preprocessing liquid to the transfer member, or application of the preprocessing liquid onto the transfer member varies due to the presence of the dust/foreign substance. In particular, the preprocessing liquid applied to the transfer member is set in a thin film-like state, and thus easily influenced by the dust or the foreign substance. Furthermore, if the transfer member reaches the position of the preprocessing unit again after making one revolution, the applied preprocessing liquid is transferred to a roller that applies this again. Consequently, owing to the preprocessing liquid or the like, a processing liquid is not applied to the transfer member uniformly.

A case in which the contact sequence of the preprocessing unit→the liquid collection unit is not maintained Because the processing liquid is not applied to the transfer member before the liquid collection unit removes a liquid, the transfer member in a dry condition contacts the liquid collection unit, and damage to one of the transfer member and the liquid collection unit is likely to be caused due to friction between them even if a small speed difference occurs between them. In addition, the liquid collection unit cannot collect a part of the preprocessing liquid, increasing the collection amount of the preprocessing liquid in the cleaning unit in subsequent-processing. This imposes a large load on a cleaning operation by the cleaning unit.

A case in which the contact sequence of the preprocessing unit→the image forming unit is not maintained Because the preprocessing liquid is not applied to the transfer member, a reaction between the preprocessing liquid and ink discharged from a printhead to the transfer member does not occur, making it impossible to form an image appropriately.

(2) At the Stop of Printing Operation

A case in which the separation sequence of the liquid collection unit→the preprocessing unit is not maintained The liquid collection unit contacts the transfer member in a dry condition in which the preprocessing liquid is not applied to the transfer member, and damage to one of the transfer member and the liquid collection unit is likely to be caused due to occurrence of friction by the small speed difference between them.

A case in which the separation sequence of the preprocessing unit→the cleaning unit is not maintained The preprocessing liquid remains applied onto the transfer member.

SUMMARY OF THE INVENTION

Accordingly, the present invention is conceived as a response to the above-described disadvantages of the conventional art.

For example, an inkjet printing apparatus according to this invention is capable of properly maintaining a contact sequence and a separation sequence of respective constituent elements with respect to a transfer member at the start and at the stop of a printing operation, and printing a higher-quality image.

According to one aspect of the present invention, there is provided an inkjet printing apparatus comprising: a transfer member; a printhead configured to discharge ink to the transfer member and print an image; a transfer unit configured to transfer the image from the transfer member to a print medium; a cleaning unit configured to clean the transfer member; and an application unit configured to apply a reactive liquid with the ink to the transfer member, wherein at a start of a printing operation by the printhead, the cleaning unit is brought into contact with the transfer member to clean the transfer member before the application unit is brought into contact with the transfer member.

According to another aspect of the present invention, there is provided an inkjet printing apparatus comprising: a transfer member; a printhead configured to discharge ink to the transfer member and print an image; a transfer unit configured to transfer the image from the transfer member to a print medium; an application unit configured to apply a reactive liquid with the ink to the transfer member; and an absorbing unit configured to absorb a liquid component from the reactive liquid applied by the application unit to the transfer member, wherein at a start of a printing operation by the printhead, the application unit is brought into contact with the transfer member to apply the reactive liquid before the absorbing unit is brought into contact with the transfer member.

According to still another aspect of the present invention, there is provided an inkjet printing apparatus comprising: a transfer member; a printhead configured to discharge ink to the transfer member and print an image; a transfer unit configured to transfer the image from the transfer member to a print medium; a cleaning unit configured to clean the transfer member; and an application unit configured to apply a reactive liquid with the ink to the transfer member, wherein the cleaning unit is separated from the transfer member after the application unit is separated from the transfer member.

According to still another aspect of the present invention, there is provided an inkjet printing apparatus comprising: a transfer member; a printhead configured to discharge ink to the transfer member and print an image; a transfer unit configured to transfer the image from the transfer member to a print medium; an application unit configured to apply a reactive liquid with the ink to the transfer member; and an absorbing unit configured to absorb a liquid component from the reactive liquid applied by the application unit to the transfer member, wherein the application unit is separated from the transfer member after the absorbing unit is separated from the transfer member.

The invention is particularly advantageous since it is possible to properly maintain a contact sequence and a separation sequence of respective constituent elements with respect to a transfer member at the start and at the stop of a printing operation, and print a higher-quality image.

Further features of the present invention will become apparent from the following description of exemplary embodiments (with reference to the attached drawings).

DESCRIPTION OF THE EMBODIMENTS

Exemplary embodiments of the present invention will now be described in detail in accordance with the accompanying drawings. Note that in each drawing, arrows X and Y indicate horizontal directions perpendicular to each other, and an arrow Z indicates a up/down direction.

<Description of Terms>

In this specification, the terms "print" and "printing" not only include the formation of significant information such as characters and graphics, but also broadly includes the formation of images, figures, patterns, and the like on a print medium, or the processing of the medium, regardless of whether they are significant or insignificant and whether they are so visualized as to be visually perceivable by humans.

Also, the term "print medium (or sheet)" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be broadly interpreted to be similar to the definition of "print" described above. That is, "ink" includes a liquid which, when applied onto a print medium, can form images, figures, patterns, and the like, can process the print medium, and can process ink. The process of ink includes, for example, solidifying or insolubilizing a coloring agent contained in ink applied to the print medium. Note that this invention is not limited to any specific ink component, however, it is assumed that this embodiment uses water-base ink including water, resin, and pigment serving as coloring material.

Further, a "print element (or nozzle)" generically means an ink orifice or a liquid channel communicating with it, and an element for generating energy used to discharge ink, unless otherwise specified.

An element substrate for a printhead (head substrate) used below means not merely a base made of a silicon semiconductor, but an arrangement in which elements, wirings, and the like are arranged.

Further, "on the substrate" means not merely "on an element substrate", but even "the surface of the element substrate" and "inside the element substrate near the surface". In the present invention, "built-in" means not merely arranging respective elements as separate members on the base surface, but integrally forming and manufacturing respective elements on an element substrate by a semiconductor circuit manufacturing process or the like.

<Printing System>

Figure 1:
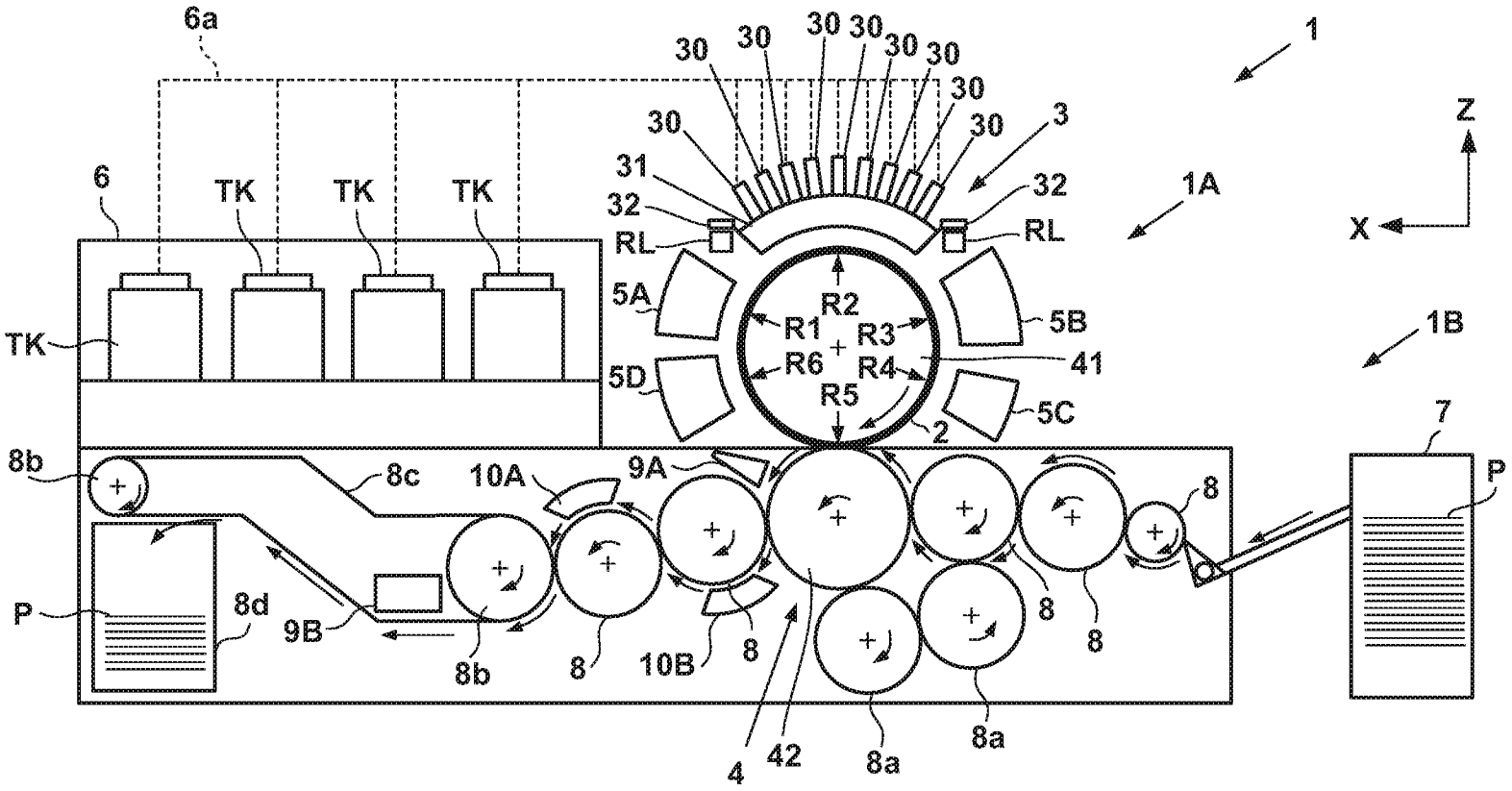
FIG. 1 is a schematic view showing a printing system according to an exemplary embodiment of the present invention.

FIG. 1 is a front view schematically showing a printing system 1 according to an embodiment of the present invention. The printing system 1 is a sheet inkjet printer that forms a printed product P' by transferring an ink image to a print medium P via a transfer member 2. The printing system 1 includes a printing apparatus 1A and a conveyance apparatus 1B. In this embodiment, an X direction, a Y direction, and a Z direction indicate the widthwise direction (total length direction), the depth direction, and the height direction of the printing system 1, respectively. The print medium P is conveyed in the X direction.

<Printing Apparatus>

The printing apparatus 1A includes a print unit 3, a transfer unit 4, peripheral units 5A to 5D, and a supply unit 6.

<Print Unit>

Figure 2:
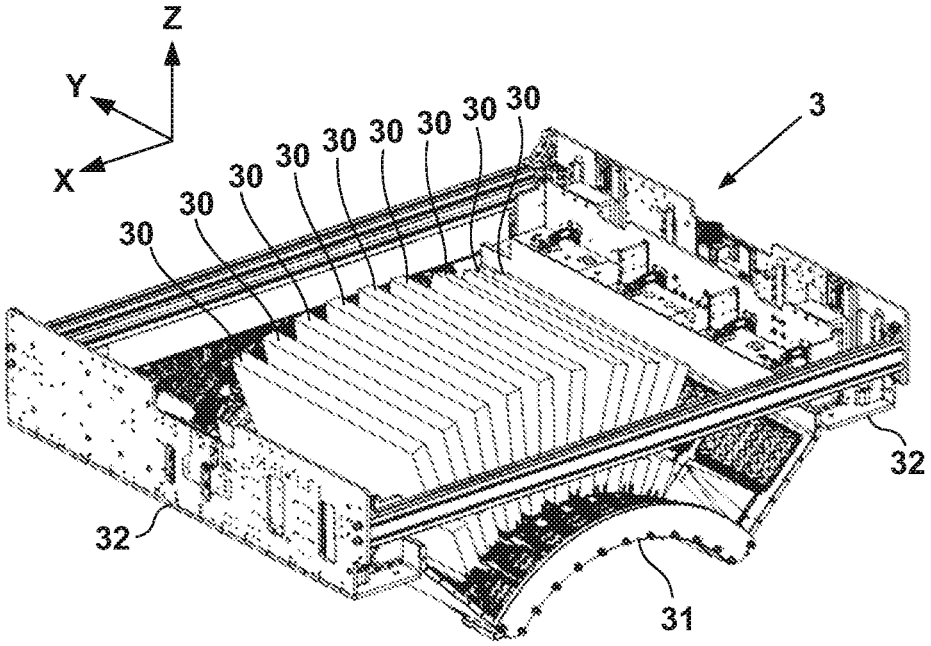
FIG. 2 is a perspective view showing a print unit.

The print unit 3 includes a plurality of printheads 30 and a carriage 31. A description will be made with reference to FIGS. 1 and 2. FIG. 2 is perspective view showing the print unit 3. The printheads 30 discharge liquid ink to the transfer member (intermediate transfer member) 2 and form ink images of a printed image on the transfer member 2.

In this embodiment, each printhead 30 is a full-line head elongated in the Y direction, and nozzles are arrayed in a range where they cover the width of an image printing area of a print medium having a usable maximum size. Each printhead 30 has an ink discharge surface with the opened nozzle on its lower surface, and the ink discharge surface faces the surface of the transfer member 2 via a minute gap (for example, several mm). In this embodiment, the transfer member 2 is configured to move on a circular orbit cyclically, and thus the plurality of printheads 30 are arranged radially.

Each nozzle includes a discharge element. The discharge element is, for example, an element that generates a pressure in the nozzle and discharges ink in the nozzle, and the technique of an inkjet head in a well-known inkjet printer is applicable. For example, an element that discharges ink by causing film boiling in ink with an electrothermal transducer and forming a bubble, an element that discharges ink by an electromechanical transducer (piezoelectric element), an element that discharges ink by using static electricity, or the like can be given as the discharge element. A discharge element that uses the electrothermal transducer can be used from the viewpoint of high-speed and high-density printing.

In this embodiment, nine printheads 30 are provided. The respective printheads 30 discharge different kinds of inks. The different kinds of inks are, for example, different in coloring material and include yellow ink, magenta ink, cyan ink, black ink, and the like. One printhead 30 discharges one kind of ink. However, one printhead 30 may be configured to discharge the plurality of kinds of inks. When the plurality of printheads 30 are thus provided, some of them may discharge ink (for example, clear ink) that does not include a coloring material.

The carriage 31 supports the plurality of printheads 30. The end of each printhead 30 on the side of an ink discharge surface is fixed to the carriage 31. This makes it possible to maintain a gap on the surface between the ink discharge surface and the transfer member 2 more precisely. The carriage 31 is configured to be displaceable while mounting the printheads 30 by the guide of each guide member RL. In this embodiment, the guide members RL are rail members elongated in the Y direction and provided as a pair separately in the X direction. A slide portion 32 is provided on each side of the carriage 31 in the X direction. The slide portions 32 engage with the guide members RL and slide along the guide members RL in the Y direction.

Figure 3:
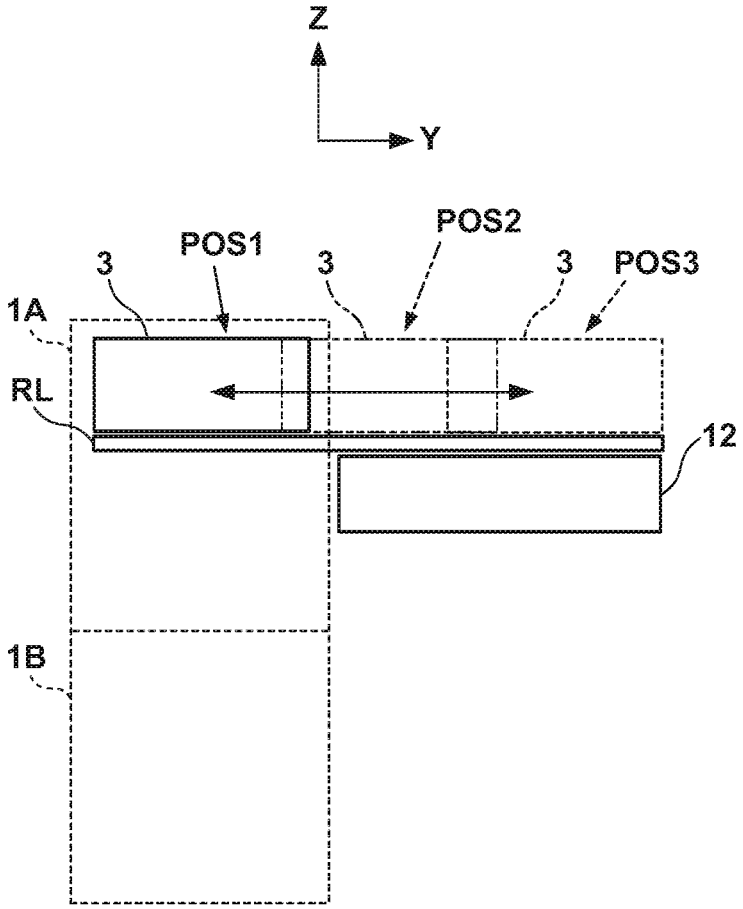
FIG. 3 is an explanatory view showing a displacement mode of the print unit in FIG. 2.

FIG. 3 is a view showing a displacement mode of the print unit 3 and schematically shows the right side surface of the printing system 1. A recovery unit 12 is provided in the rear of the printing system 1. The recovery unit 12 has a mechanism for recovering discharge performance of the printheads 30. For example, a cap mechanism which caps the ink discharge surface of each printhead 30, a wiper mechanism which wipes the ink discharge surface, a suction mechanism which sucks ink in the printhead 30 by a negative pressure from the ink discharge surface can be given as such mechanisms.

The guide member RL is elongated over the recovery unit 12 from the side of the transfer member 2. By the guide of the guide member RL, the print unit 3 is displaceable between a discharge position POS1 at which the print unit 3 is indicated by a solid line and a recovery position POS3 at which the print unit 3 is indicated by a broken line, and is moved by a driving mechanism (not shown).

The discharge position POS1 is a position at which the print unit 3 discharges ink to the transfer member 2 and a position at which the ink discharge surface of each printhead 30 faces the surface of the transfer member 2. The recovery position POS3 is a position retracted from the discharge position POS1 and a position at which the print unit 3 is positioned above the recovery unit 12. The recovery unit 12 can perform recovery processing on the printheads 30 when the print unit 3 is positioned at the recovery position POS3. In this embodiment, the recovery unit 12 can also perform the recovery processing in the middle of movement before the print unit 3 reaches the recovery position POS3. There is a preliminary recovery position POS2 between the discharge position POS1 and the recovery position POS3. The recovery unit 12 can perform preliminary recovery processing on the printheads 30 at the preliminary recovery position POS2 while the printheads 30 move from the discharge position POS1 to the recovery position POS3.

<Transfer Unit>

The transfer unit 4 will be described with reference to FIG. 1. The transfer unit 4 includes a transfer drum 41 and a pressurizing drum 42. Each of these drums is a rotating body that rotates about a rotation axis in the Y direction and has a columnar outer peripheral surface. In FIG. 1, arrows shown in respective views of the transfer drum 41 and the pressurizing drum 42 indicate their rotation directions. The transfer drum 41 rotates clockwise, and the pressurizing drum 42 rotates anticlockwise.

The transfer drum 41 is a support member that supports the transfer member 2 on its outer peripheral surface. The transfer member 2 is provided on the outer peripheral surface of the transfer drum 41 continuously or intermittently in a circumferential direction. If the transfer member 2 is provided continuously, it is formed into an endless swath. If the transfer member 2 is provided intermittently, it is formed into swaths with ends dividedly into a plurality of segments. The respective segments can be arranged in an arc at an equal pitch on the outer peripheral surface of the transfer drum 41.

The transfer member 2 moves cyclically on the circular orbit by rotating the transfer drum 41. By the rotational phase of the transfer drum 41, the position of the transfer member 2 can be discriminated into a processing area R1 before discharge, a discharge area R2, processing areas R3 and R4 after discharge, a transfer area R5, and a processing area R6 after transfer. The transfer member 2 passes through these areas cyclically.

The processing area R1 before discharge is an area where preprocessing is performed on the transfer member 2 before the print unit 3 discharges ink and an area where the peripheral unit 5A performs processing. In this embodiment, a reactive liquid is applied. The discharge area R2 is a formation area where the print unit 3 forms an ink image by discharging ink to the transfer member 2. The processing areas R3 and R4 after discharge are processing areas where processing is performed on the ink image after ink discharge. The processing area R3 after discharge is an area where the peripheral unit 5B performs processing, and the processing area R4 after discharge is an area where the peripheral unit 5C performs processing. The transfer area R5 is an area where the transfer unit 4 transfers the ink image on the transfer member 2 to the print medium P. The processing area R6 after transfer is an area where post processing is performed on the transfer member 2 after transfer and an area where the peripheral unit 5D performs processing.

In this embodiment, the discharge area R2 is an area with a predetermined section. The other areas R1 and R3 to R6 have narrower sections than the discharge area R2. Comparing to the face of a clock, in this embodiment, the processing area R1 before discharge is positioned at almost 10 o'clock, the discharge area R2 is in a range from almost 11 o'clock to 1 o'clock, the processing area R3 after discharge is positioned at almost 2 o'clock, and the processing area R4 after discharge is positioned at almost 4 o'clock. The transfer area R5 is positioned at almost 6 o'clock, and the processing area R6 after transfer is an area at almost 8 o'clock.

The transfer member 2 may be formed by a single layer but may be an accumulative body of a plurality of layers. If the transfer member 2 is formed by the plurality of layers, it may include three layers of, for example, a surface layer, an elastic layer, and a compressed layer. The surface layer is an outermost layer having an image formation surface where the ink image is formed. By providing the compressed layer, the compressed layer absorbs deformation and disperses a local pressure fluctuation, making it possible to maintain transferability even at the time of high-speed printing. The elastic layer is a layer between the surface layer and the compressed layer.

As a material for the surface layer, various materials such as a resin and a ceramic can be used appropriately. In respect of durability or the like, however, a material high in compressive modulus can be used. More specifically, an acrylic resin, an acrylic silicone resin, a fluoride-containing resin, a condensate obtained by condensing a hydrolyzable organosilicon compound, and the like can be given. The surface layer that has undergone a surface treatment may be used in order to improve wettability of the reactive liquid, the transferability of an image, or the like. Frame processing, a corona treatment, a plasma treatment, a polishing treatment, a roughing treatment, an active energy beam irradiation treatment, an ozone treatment, a surfactant treatment, a silane coupling treatment, or the like can be given as the surface treatment. A plurality of them may be combined. It is also possible to provide any desired surface shape in the surface layer.

For example, acrylonitrile-butadiene rubber, acrylic rubber, chloroprene rubber, urethane rubber, silicone rubber, or the like can be given as a material for the compressed layer. When such a rubber material is formed, a porous rubber material may be formed by blending a predetermined amount of a vulcanizing agent, vulcanizing accelerator, or the like and further blending a foaming agent, or a filling agent such as hollow fine particles or salt as needed. Consequently, a bubble portion is compressed along with a volume change with respect to various pressure fluctuations, and thus deformation in directions other than a compression direction is small, making it possible to obtain more stable transferability and durability. As the porous rubber material, there are a material having an open cell structure in which respective pores continue to each other and a material having a closed cell structure in which the respective pores are independent of each other. However, either structure may be used, or both of these structures may be used.

As a member for the elastic layer, the various materials such as the resin and the ceramic can be used appropriately. In respect of processing characteristics, various materials of an elastomer material and a rubber material can be used. More specifically, for example, fluorosilicone rubber, phenyl silicone rubber, fluorine rubber, chloroprene rubber, urethane rubber, nitrile rubber, and the like can be given. In addition, ethylene propylene rubber, natural rubber, styrene rubber, isoprene rubber, butadiene rubber, the copolymer of ethylene/propylene/butadiene, nitrile-butadiene rubber, and the like can be given. In particular, silicone rubber, fluorosilicone rubber, and phenyl silicon rubber are advantageous in terms of dimensional stability and durability because of their small compression set. They are also advantageous in terms of transferability because of their small elasticity change by a temperature.

Between the surface layer and the elastic layer and between the elastic layer and the compressed layer, various adhesives or double-sided adhesive tapes can also be used in order to fix them to each other. The transfer member 2 may also include a reinforce layer high in compressive modulus in order to suppress elongation in a horizontal direction or maintain resilience when attached to the transfer drum 41. Woven fabric may be used as a reinforce layer. The transfer member 2 can be manufactured by combining the respective layers formed by the materials described above in any desired manner.

The outer peripheral surface of the pressurizing drum 42 is pressed against the transfer member 2. At least one grip mechanism which grips the leading edge portion of the print medium P is provided on the outer peripheral surface of the pressurizing drum 42. A plurality of grip mechanisms may be provided separately in the circumferential direction of the pressurizing drum 42. The ink image on the transfer member 2 is transferred to the print medium P when it passes through a nip portion between the pressurizing drum 42 and the transfer member 2 while being conveyed in tight contact with the outer peripheral surface of the pressurizing drum 42.

The transfer drum 41 and the pressurizing drum 42 share a driving source such as a motor that drives them. A driving force can be delivered by a transmission mechanism such as a gear mechanism.

<Peripheral Unit>

The peripheral units 5A to 5D are arranged around the transfer drum 41. In this embodiment, the peripheral units 5A to 5D are specifically an application unit, an absorption unit, a heating unit, and a cleaning unit in order.

The application unit 5A is a mechanism which applies the reactive liquid onto the transfer member 2 before the print unit 3 discharges ink. The reactive liquid is a liquid that contains a component increasing an ink viscosity. An increase in ink viscosity here means that a coloring material, a resin, and the like that form the ink react chemically or suck physically by contacting the component that increases the ink viscosity, recognizing the increase in ink viscosity. This increase in ink viscosity includes not only a case in which an increase in viscosity of entire ink is recognized but also a case in which a local increase in viscosity is generated by coagulating some of components such as the coloring material and the resin that form the ink.

The component that increases the ink viscosity can use, without particular limitation, a substance such as metal ions or a polymeric coagulant that causes a pH change in ink and coagulates the coloring material in the ink, and can use an organic acid. For example, a roller, a printhead, a die coating apparatus (die coater), a blade coating apparatus (blade coater), or the like can be given as a mechanism which applies the reactive liquid. If the reactive liquid is applied to the transfer member 2 before the ink is discharged to the transfer member 2, it is possible to immediately fix ink that reaches the transfer member 2. This makes it possible to suppress bleeding caused by mixing adjacent inks.

The absorption unit 5B is a mechanism which absorbs a liquid component from the ink image on the transfer member 2 before transfer. It is possible to suppress, for example, a blur of an image printed on the print medium P by decreasing the liquid component of the ink image. Describing a decrease in liquid component from another point of view, it is also possible to represent it as condensing ink that forms the ink image on the transfer member 2. Condensing the ink means increasing the content of a solid content such as a coloring material or a resin included in the ink with respect to the liquid component by decreasing the liquid component included in the ink.

The absorption unit 5B includes, for example, a liquid absorbing member that decreases the amount of the liquid component of the ink image by contacting the ink image. The liquid absorbing member may be formed on the outer peripheral surface of the roller or may be formed into an endless sheet-like shape and run cyclically. In terms of protection of the ink image, the liquid absorbing member may be moved in synchronism with the transfer member 2 by making the moving speed of the liquid absorbing member equal to the peripheral speed of the transfer member 2.

The liquid absorbing member may include a porous body that contacts the ink image. The pore size of the porous body on the surface that contacts the ink image may be equal to or smaller than 10 μm in order to suppress adherence of an ink solid content to the liquid absorbing member. The pore size here refers to an average diameter and can be measured by a known means such as a mercury intrusion technique, a nitrogen adsorption method, an SEM image observation, or the like. Note that the liquid component does not have a fixed shape, and is not particularly limited if it has fluidity and an almost constant volume. For example, water, an organic solvent, or the like contained in the ink or reactive liquid can be given as the liquid component.

The heating unit 5C is a mechanism which heats the ink image on the transfer member 2 before transfer. A resin in the ink image melts by heating the ink image, improving transferability to the print medium P. A heating temperature can be equal to or higher than the minimum film forming temperature (MFT) of the resin. The MFT can be measured by each apparatus that complies with a generally known method such as HS K 6828-2: 2003 or ISO 2115: 1996. From the viewpoint of transferability and image robustness, the ink image may be heated at a temperature higher than the MFT by 10° C. or higher, or may further be heated at a temperature higher than the MFT by 20° C. or higher. The heating unit 5C can use a known heating device, for example, various lamps such as infrared rays, a warm air fan, or the like. An infrared heater can be used in terms of heating efficiency.

The cleaning unit 5D is a mechanism which cleans the transfer member 2 after transfer. The cleaning unit 5D removes ink remaining on the transfer member 2, dust on the transfer member 2, or the like. The cleaning unit 5D can use a known method, for example, a method of bringing a porous member into contact with the transfer member 2, a method of scraping the surface of the transfer member 2 with a brush, a method of scratching the surface of the transfer member 2 with a blade, or the like as needed. A known shape such as a roller shape or a web shape can be used for a cleaning member used for cleaning.

As described above, in this embodiment, the application unit 5A, the absorption unit 5B, the heating unit 5C, and the cleaning unit 5D are included as the peripheral units. However, cooling functions of the transfer member 2 may be applied, or cooling units may be added to these units. In this embodiment, the temperature of the transfer member 2 may be increased by heat of the heating unit 5C. If the ink image exceeds the boiling point of water as a prime solvent of ink after the print unit 3 discharges ink to the transfer member 2, performance of liquid component absorption by the absorption unit 5B may be degraded. It is possible to maintain the performance of liquid component absorption by cooling the transfer member 2 such that the temperature of the discharged ink is maintained below the boiling point of water.

The cooling unit may be an air blowing mechanism which blows air to the transfer member 2, or a mechanism which brings a member (for example, a roller) into contact with the transfer member 2 and cools this member by air-cooling or water-cooling. The cooling unit may be a mechanism which cools the cleaning member of the cleaning unit 5D. A cooling timing may be a period before application of the reactive liquid after transfer.

<Supply Unit>

The supply unit 6 is a mechanism which supplies ink to each printhead 30 of the print unit 3. The supply unit 6 may be provided on the rear side of the printing system 1. The supply unit 6 includes a reservoir TK that reserves ink for each kind of ink. Each reservoir TK may be made of a main tank and a sub tank. Each reservoir TK and a corresponding one of the printheads 30 communicate with each other by a liquid passageway 6*a*, and ink is supplied from the reservoir TK to the printhead 30. The liquid passageway 6*a* may circulate ink between the reservoirs TK and the printheads 30. The supply unit 6 may include, for example, a pump that circulates ink. A deaerating mechanism which deaerates bubbles in ink may be provided in the middle of the liquid passageway 6*a* or in each reservoir TK. A valve that adjusts the fluid pressure of ink and an atmospheric pressure may be provided in the middle of the liquid passageway 6*a* or in each reservoir TK. The heights of each reservoir TK and each printhead 30 in the Z direction may be designed such that the liquid surface of ink in the reservoir TK is positioned lower than the ink discharge surface of the printhead 30.

<Conveyance Apparatus>

The conveyance apparatus 1B is an apparatus that feeds the print medium P to the transfer unit 4 and discharges, from the transfer unit 4, the printed product P' to which the ink image was transferred. The conveyance apparatus 1B includes a feeding unit 7, a plurality of conveyance drums 8 and 8*a*, two sprockets 8*b*, a chain 8*c*, and a collection unit 8*d*. In FIG. 1, an arrow inside a view of each constituent element in the conveyance apparatus 1B indicates a rotation direction of the constituent element, and an arrow outside the view of each constituent element indicates a conveyance path of the print medium P or the printed product P'. The print medium P is conveyed from the feeding unit 7 to the transfer unit 4, and the printed product P' is conveyed from the transfer unit 4 to the collection unit 8*d*. The side of the feeding unit 7 may be referred to as an upstream side in a conveyance direction, and the side of the collection unit 8*d* may be referred to as a downstream side.

The feeding unit 7 includes a stacking unit where the plurality of print media P are stacked and a feeding mechanism which feeds the print media P one by one from the stacking unit to the most upstream conveyance drum 8. Each of the conveyance drums 8 and 8*a* is a rotating body that rotates about the rotation axis in the Y direction and has a columnar outer peripheral surface. At least one grip mechanism which grips the leading edge portion of the print medium P (printed product P') is provided on the outer peripheral surface of each of the conveyance drums 8 and 8*a*. A gripping operation and release operation of each grip mechanism may be controlled such that the print medium P is transferred between the adjacent conveyance drums.

The two conveyance drums 8*a* are used to reverse the print medium P. When the print medium P undergoes double-side printing, it is not transferred to the conveyance drum 8 adjacent on the downstream side but transferred to the conveyance drums 8*a* from the pressurizing drum 42 after transfer onto the surface. The print medium P is reversed via the two conveyance drums 8*a* and transferred to the pressurizing drum 42 again via the conveyance drums 8 on the upstream side of the pressurizing drum 42. Consequently, the reverse surface of the print medium P faces the transfer drum 41, transferring the ink image to the reverse surface.

The chain 8*c* is wound between the two sprockets 8*b*. One of the two sprockets 8*b* is a driving sprocket, and the other is a driven sprocket. The chain 8*c* runs cyclically by rotating the driving sprocket. The chain 8*c* includes a plurality of grip mechanisms spaced apart from each other in its longitudinal direction. Each grip mechanism grips the end of the printed product P'. The printed product P' is transferred from the conveyance drum 8 positioned at a downstream end to each grip mechanism of the chain 8*c*, and the printed product P' gripped by the grip mechanism is conveyed to the collection unit 8*d* by running the chain 8*c*, releasing gripping. Consequently, the printed product P' is stacked in the collection unit 8*d*.

<Post Processing Unit>

The conveyance apparatus 1B includes post processing units 10A and 10B. The post processing units 10A and 10B are mechanisms which are arranged on the downstream side of the transfer unit 4, and perform post processing on the printed product P'. The post processing unit 10A performs processing on the obverse surface of the printed product P', and the post processing unit 10B performs processing on the reverse surface of the printed product P'. The contents of the post processing includes, for example, coating that aims at protection, glossy, and the like of an image on the image printed surface of the printed product P'. For example, liquid application, sheet welding, lamination, and the like can be given as an example of coating.

<Inspection Unit>

The conveyance apparatus 1B includes inspection units 9A and 9B. The inspection units 9A and 9B are mechanisms which are arranged on the downstream side of the transfer unit 4, and inspect the printed product P'.

In this embodiment, the inspection unit 9A is an image capturing apparatus that captures an image printed on the printed product P' and includes an image sensor, for example, a CCD sensor, a CMOS sensor, or the like. The inspection unit 9A captures a printed image while a printing operation is performed continuously. Based on the image captured by the inspection unit 9A, it is possible to confirm a temporal change in tint or the like of the printed image and determine whether to correct image data or print data. In this embodiment, the inspection unit 9A has an imaging range set on the outer peripheral surface of the pressurizing drum 42 and is arranged to be able to partially capture the printed image immediately after transfer. The inspection unit 9A may inspect all printed images or may inspect the images every predetermined sheets.

In this embodiment, the inspection unit 9B is also an image capturing apparatus that captures an image printed on the printed product P' and includes an image sensor, for example, a CCD sensor, a CMOS sensor, or the like. The inspection unit 9B captures a printed image in a test printing operation. The inspection unit 9B can capture the entire printed image. Based on the image captured by the inspection unit 9B, it is possible to perform basic settings for various correction operations regarding print data. In this embodiment, the inspection unit 9B is arranged at a position to capture the printed product P' conveyed by the chain 8*c*. When the inspection unit 9B captures the printed image, it captures the entire image by temporarily suspending the run of the chain 8*c*. The inspection unit 9B may be a scanner that scans the printed product P'.

<Control Unit>

Figure 4:
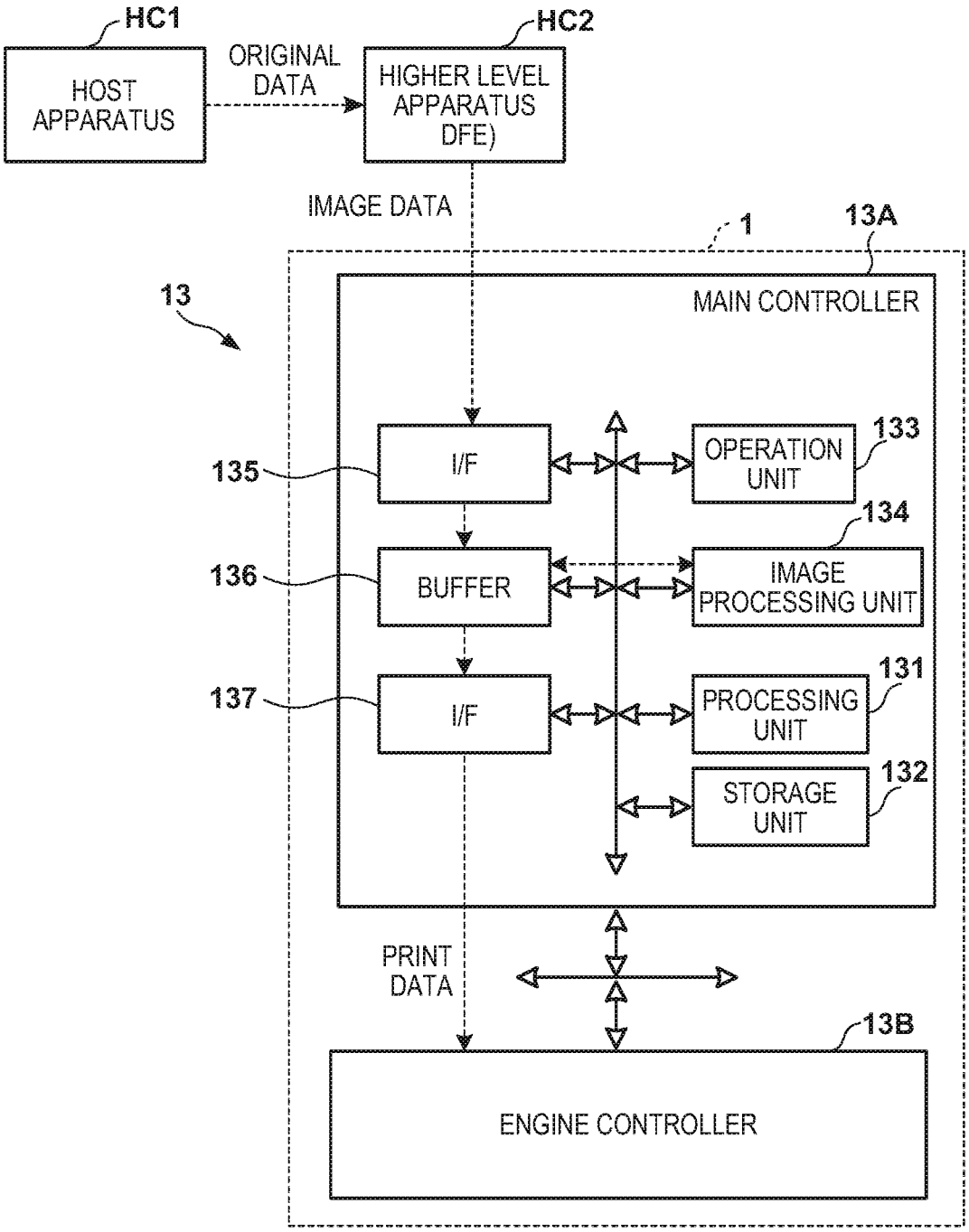
FIG. 4 is a block diagram showing a control system of the printing system in FIG. 1.
Figure 5:
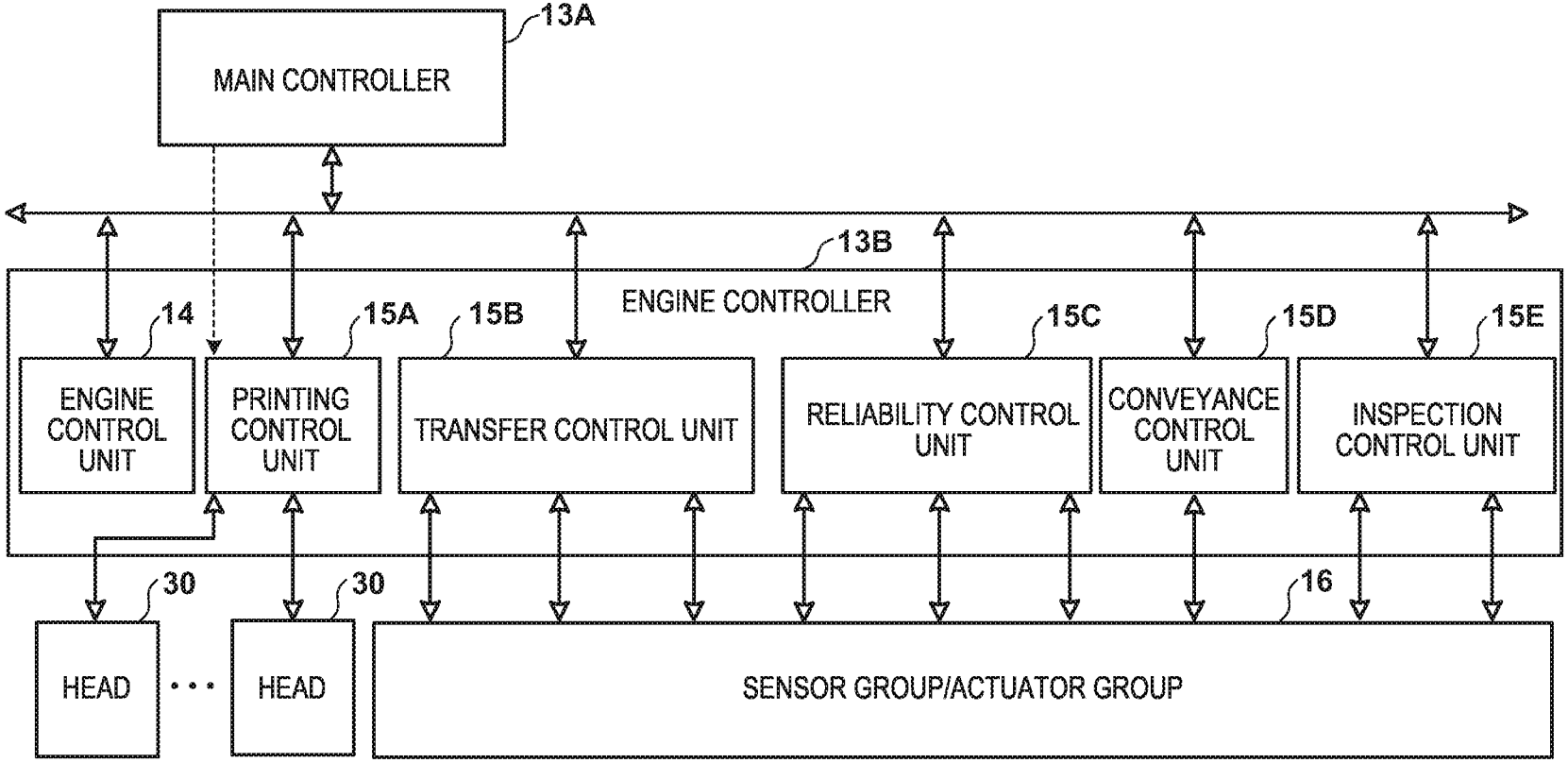
FIG. 5 is a block diagram showing the control system of the printing system in FIG. 1.

A control unit of the printing system 1 will be described next. FIGS. 4 and 5 are block diagrams each showing a control unit 13 of the printing system 1. The control unit 13 is communicably connected to a higher level apparatus (DFE) HC2, and the higher level apparatus HC2 is communicably connected to a host apparatus HC1.

The host apparatus HC1 may be, for example, a PC (Personal Computer) serving as an information processing apparatus, or a server apparatus. A communication method between the host apparatus HC1 and the higher level apparatus HC2 may be, without particular limitation, either wired or wireless communication.

Original data to be the source of a printed image is generated or saved in the host apparatus HC1. The original data here is generated in the format of, for example, an electronic file such as a document file or an image file. This original data is transmitted to the higher level apparatus HC2. In the higher level apparatus HC2, the received original data is converted into a data format (for example, RGB data that represents an image by RGB) available by the control unit 13. The converted data is transmitted from the higher level apparatus HC2 to the control unit 13 as image data. The control unit 13 starts a printing operation based on the received image data.

In this embodiment, the control unit 13 is roughly divided into a main controller 13A and an engine controller 13B. The main controller 13A includes a processing unit 131, a storage unit 132, an operation unit 133, an image processing unit 134, a communication I/F (interface) 135, a buffer 136, and a communication I/F 137.

The processing unit 131 is a processor such as a CPU, executes programs stored in the storage unit 132, and controls the entire main controller 13A. The storage unit 132 is a storage device such as a RAM, a ROM, a hard disk, or an SSD, stores data and the programs executed by the processing unit (CPU) 131, and provides the processing unit (CPU) 131 with a work area. An external storage unit may further be provided in addition to the storage unit 132. The operation unit 133 is, for example, an input device such as a touch panel, a keyboard, or a mouse and accepts a user instruction. The operation unit 133 may be formed by an input unit and a display unit integrated with each other. Note that a user operation is not limited to an input via the operation unit 133, and an arrangement may be possible in which, for example, an instruction is accepted from the host apparatus HC1 or the higher level apparatus HC2.

The image processing unit 134 is, for example, an electronic circuit including an image processing processor. The buffer 136 is, for example, a RAM, a hard disk, or an SSD. The communication I/F 135 communicates with the higher level apparatus HC2, and the communication I/F 137 communicates with the engine controller 13B. In FIG. 4, broken-line arrows exemplify the processing sequence of image data. Image data received from the higher level apparatus HC2 via the communication I/F 135 is accumulated in the buffer 136. The image processing unit 134 reads out the image data from the buffer 136, performs predetermined image processing on the readout image data, and stores the processed data in the buffer 136 again. The image data after the image processing stored in the buffer 136 is transmitted from the communication I/F 137 to the engine controller 13B as print data used by a print engine.

As shown in FIG. 5, the engine controller 13B includes an engine control units 14 and 15A to 15E, and obtains a detection result of a sensor group/actuator group 16 of the printing system 1 and controls driving of the groups. Each of these control units includes a processor such as a CPU, a storage device such as a RAM or a ROM, and an interface with an external device. Note that the division of the control units is merely illustrative, and a plurality of subdivided control units may perform some of control operations or conversely, the plurality of control units may be integrated with each other, and one control unit may be configured to implement their control contents.

The engine control unit 14 controls the entire engine controller 13B. The printing control unit 15A converts print data received from the main controller 13A into raster data or the like in a data format suitable for driving of the printheads 30. The printing control unit 15A controls discharge of each printhead 30.

The transfer control unit 15B controls the application unit 5A, the absorption unit 5B, the heating unit 5C, and the cleaning unit 5D.

The reliability control unit 15C controls the supply unit 6, the recovery unit 12, and a driving mechanism which moves the print unit 3 between the discharge position POS1 and the recovery position POS3.

The conveyance control unit 15D controls driving of the transfer unit 4 and controls the conveyance apparatus 1B. The inspection control unit 15E controls the inspection unit 9B and the inspection unit 9A.

Of the sensor group/actuator group 16, the sensor group includes a sensor that detects the position and speed of a movable part, a sensor that detects a temperature, an image sensor, and the like. The actuator group includes a motor, an electromagnetic solenoid, an electromagnetic valve, and the like.

<Operation Example>

Figure 6:
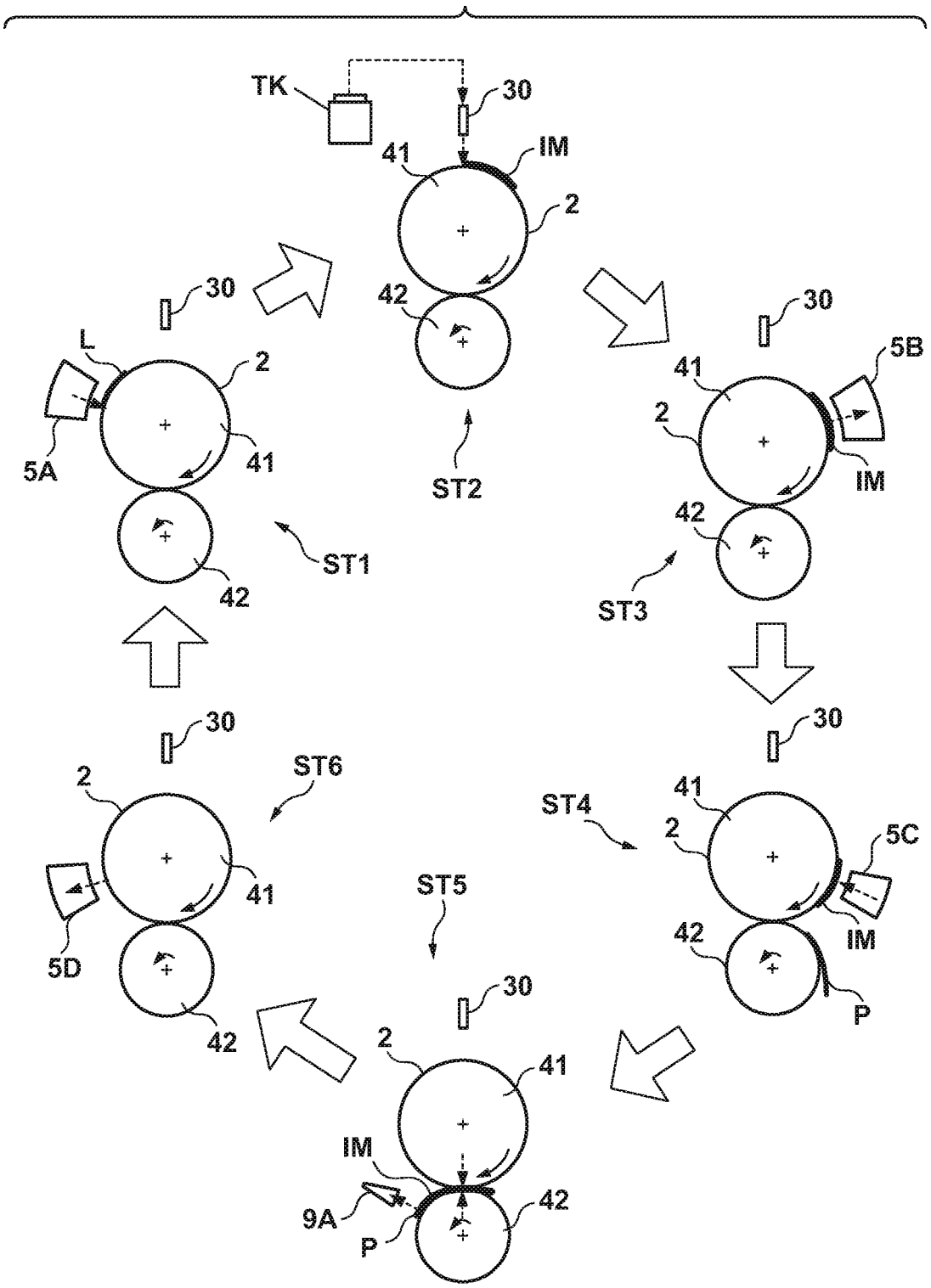
FIG. 6 is an explanatory view showing an example of the operation of the printing system in FIG. 1.

FIG. 6 is a view schematically showing an example of a printing operation. Respective steps below are performed cyclically while rotating the transfer drum 41 and the pressurizing drum 42. As shown in a state ST1, first, a reactive liquid L is applied from the application unit 5A onto the transfer member 2. A portion to which the reactive liquid L on the transfer member 2 is applied moves along with the rotation of the transfer drum 41. When the portion to which the reactive liquid L is applied reaches under the printhead 30, ink is discharged from the printhead 30 to the transfer member 2 as shown in a state ST2. Consequently, an ink image IM is formed. At this time, the discharged ink mixes with the reactive liquid L on the transfer member 2, promoting coagulation of the coloring materials. The discharged ink is supplied from the reservoir TK of the supply unit 6 to the printhead 30.

The ink image IM on the transfer member 2 moves along with the rotation of the transfer member 2. When the ink image IM reaches the absorption unit 5B, as shown in a state ST3, the absorption unit 5B absorbs a liquid component from the ink image IM. When the ink image IM reaches the heating unit 5C, as shown in a state ST4, the heating unit 5C heats the ink image IM, a resin in the ink image IM melts, and a film of the ink image IM is formed. In synchronism with such formation of the ink image IM, the conveyance apparatus 1B conveys the print medium P.

As shown in a state ST5, the ink image IM and the print medium P reach the nip portion between the transfer member 2 and the pressurizing drum 42, the ink image IM is transferred to the print medium P, and the printed product P' is formed. Passing through the nip portion, the inspection unit 9A captures an image printed on the printed product P' and inspects the printed image. The conveyance apparatus 1B conveys the printed product P' to the collection unit 8*d*.

When a portion where the ink image IM on the transfer member 2 is formed reaches the cleaning unit 5D, it is cleaned by the cleaning unit 5D as shown in a state ST6. After the cleaning, the transfer member 2 rotates once, and transfer of the ink image to the print medium P is performed repeatedly in the same procedure. The description above has been given such that transfer of the ink image IM to one print medium P is performed once in one rotation of the transfer member 2 for the sake of easy understanding. It is possible, however, to continuously perform transfer of the ink image IM to the plurality of print media P in one rotation of the transfer member 2.

Each printhead 30 needs maintenance if such a printing operation continues.

Figure 7:
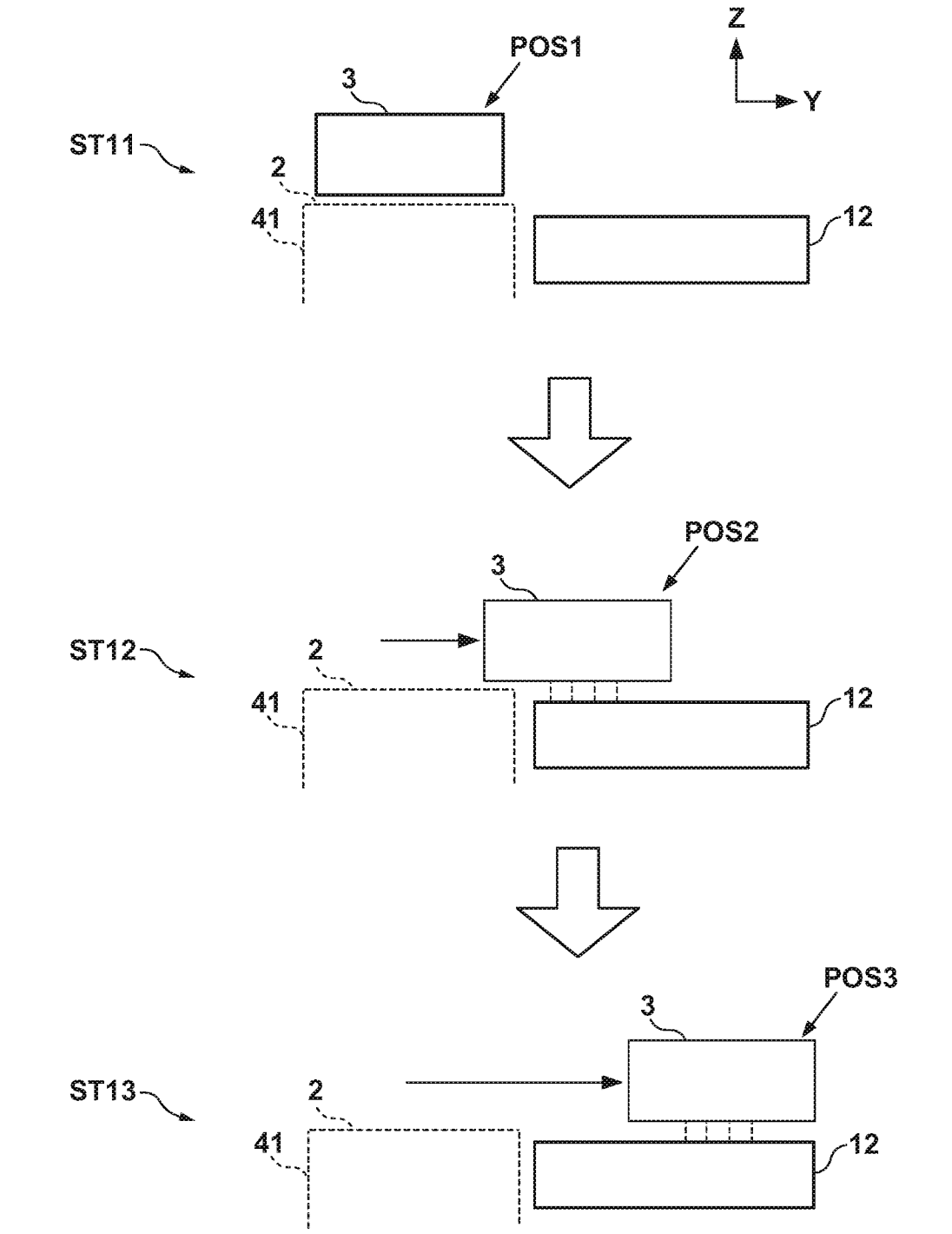
FIG. 7 is an explanatory view showing an example of the operation of the printing system in FIG. 1.

FIG. 7 shows an operation example at the time of maintenance of each printhead 30. A state ST11 shows a state in which the print unit 3 is positioned at the discharge position POS1. A state ST12 shows a state in which the print unit 3 passes through the preliminary recovery position POS2. Under passage, the recovery unit 12 performs a process of recovering discharge performance of each printhead 30 of the print unit 3. Subsequently, as shown in a state ST13, the recovery unit 12 performs the process of recovering the discharge performance of each printhead 30 in a state in which the print unit 3 is positioned at the recovery position POS3.

A contact sequence and contact processing with respect to a transfer member of respective units at the start of a printing operation, and a separation sequence and separation processing of the respective units at the stop of the printing operation in the printing system having the above arrangement will be described next.

The contact sequence of the respective units at the start of the printing operation (FIGS. 8A to 9B)

FIGS. 8A to 9B are views each showing a sequence in which the respective units contact the transfer member 2 at the start of the printing operation.

Figure 8A:
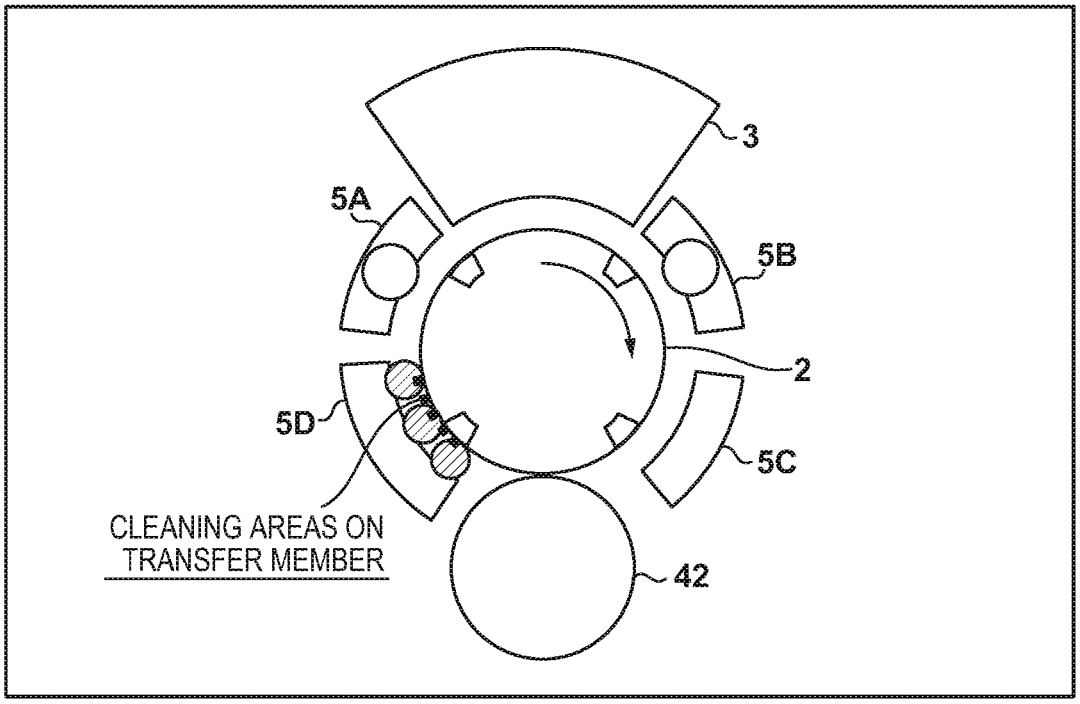
FIGS. 8A and 8B are views each showing a sequence in which the respective units contact the transfer member at the start of the printing operation.

As shown in FIG. 8A, in accordance with reception of a print (image printing) command from the host apparatus HC1, the main controller 13A issues an instruction to the engine controller 13B to rotate the transfer member 2 and start a cleaning operation by the cleaning unit 5D. In this example, rollers (full circles) of the cleaning unit 5D are first brought into contact with the transfer member 2 as shown in FIG. 8A. By thus bringing the rollers into contact with the transfer member 2, a cleaning liquid is applied from the cleaning unit 5D to the transfer member 2, and ink, dust, or the like remaining in the transfer member 2 is wiped and collected.

Figure 8B:
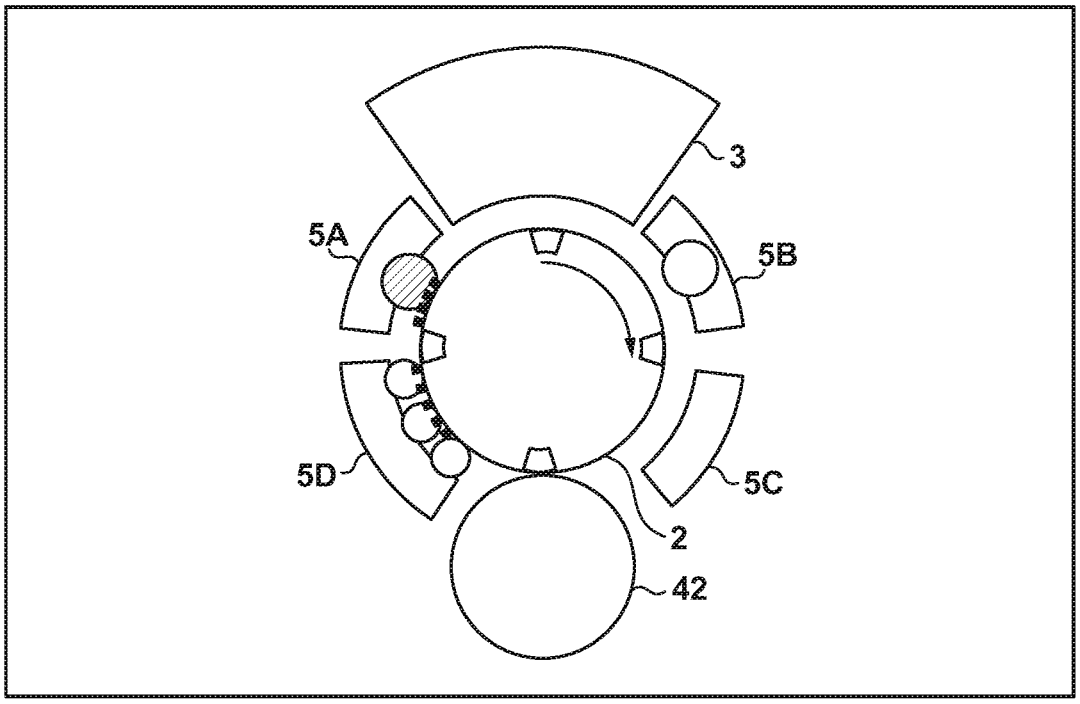

Next, when the areas of the transfer member 2 cleaned by the rollers (full circles) of the cleaning unit 5D reach the position of the roller (full circle) of the application unit 5A by rotating the transfer member 2, the roller of the application unit 5A is brought into contact with the transfer member 2 as shown in FIG. 8B. Then, when the roller applies a reactive liquid to the transfer member 2, the reactive liquid is applied onto the transfer member 2 in a thin film-like state.

Figure 9A:
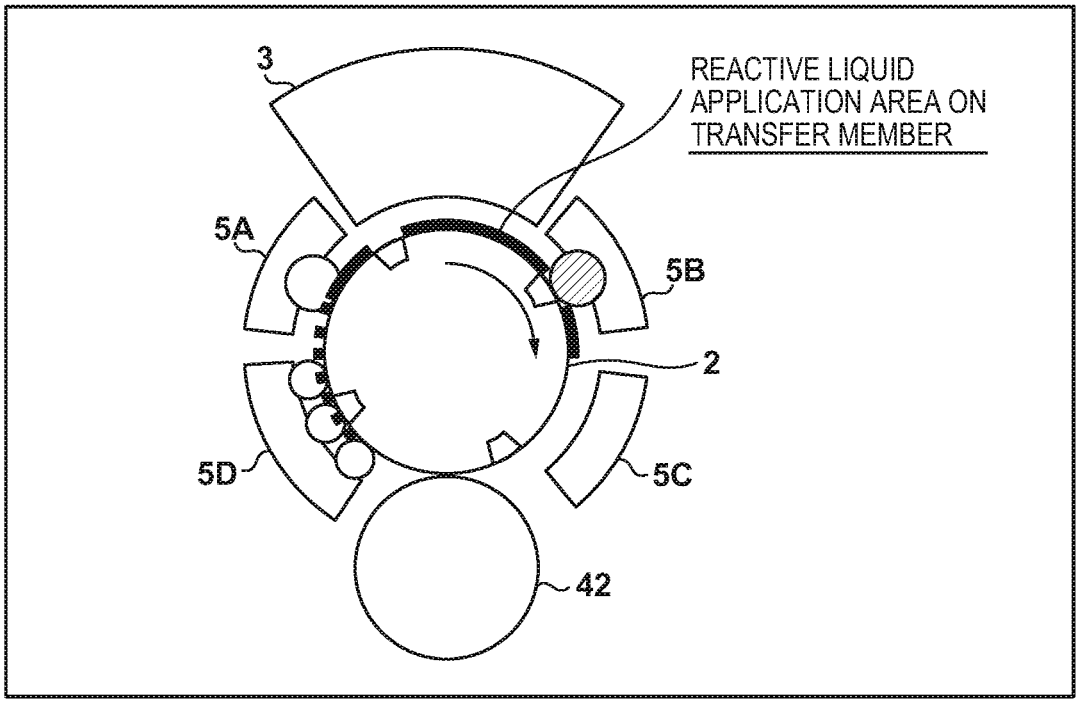
FIGS. 9A and 9B are views each showing a sequence in which the respective units contact the transfer member at the start of the printing operation.

Furthermore, when the area of the transfer member 2 to which the reactive liquid is applied by the application unit 5A reaches the position of the roller (full circle) of the absorption unit 5B by rotating the transfer member 2, the roller of the absorption unit 5B is brought into contact with the transfer member 2 as shown in FIG. 9A. Then, the roller of the absorption unit 5B absorbs a liquid component of the reactive liquid applied to the transfer member 2. In this example, the roller is brought into contact with the transfer member 2 in the concave portion thereof, collecting the liquid component. Note that the liquid component of the reactive liquid is collected over an entire widthwise direction (a direction perpendicular to a paper surface) of the transfer member 2.

Figure 9B:
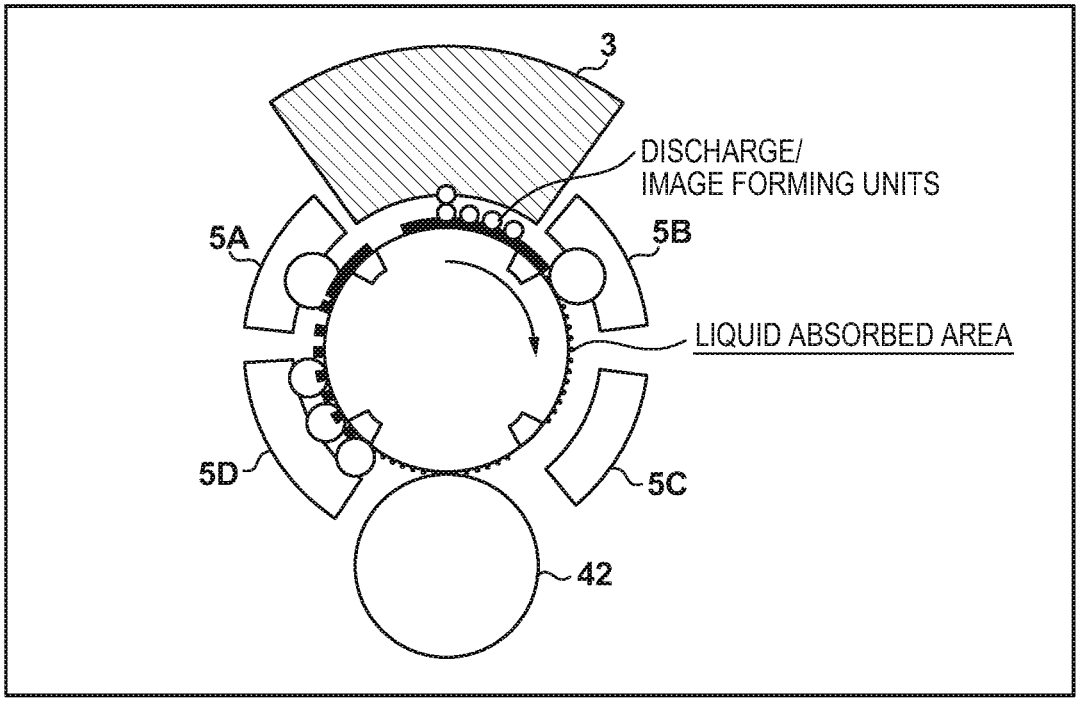

Furthermore, when areas each in which at least a part of the liquid component of the reactive liquid is absorbed by the absorption unit 5B reach the heating unit 5C by rotating the transfer member 2, the heating unit 5C heats the areas as shown in FIG. 9B. Then, after a sensor confirms that a temperature on the transfer member 2 reaches a target value by heating with the heating unit 5C, ink discharge from the printhead 30 of the print unit 3 is started to start printing.

Note that this timing is desired for heating by the heating unit 5C. However, heating need not always be performed at this timing if the temperature of the transfer member 2 has already reached the target value or falls within an appropriate range.

Figure 10:
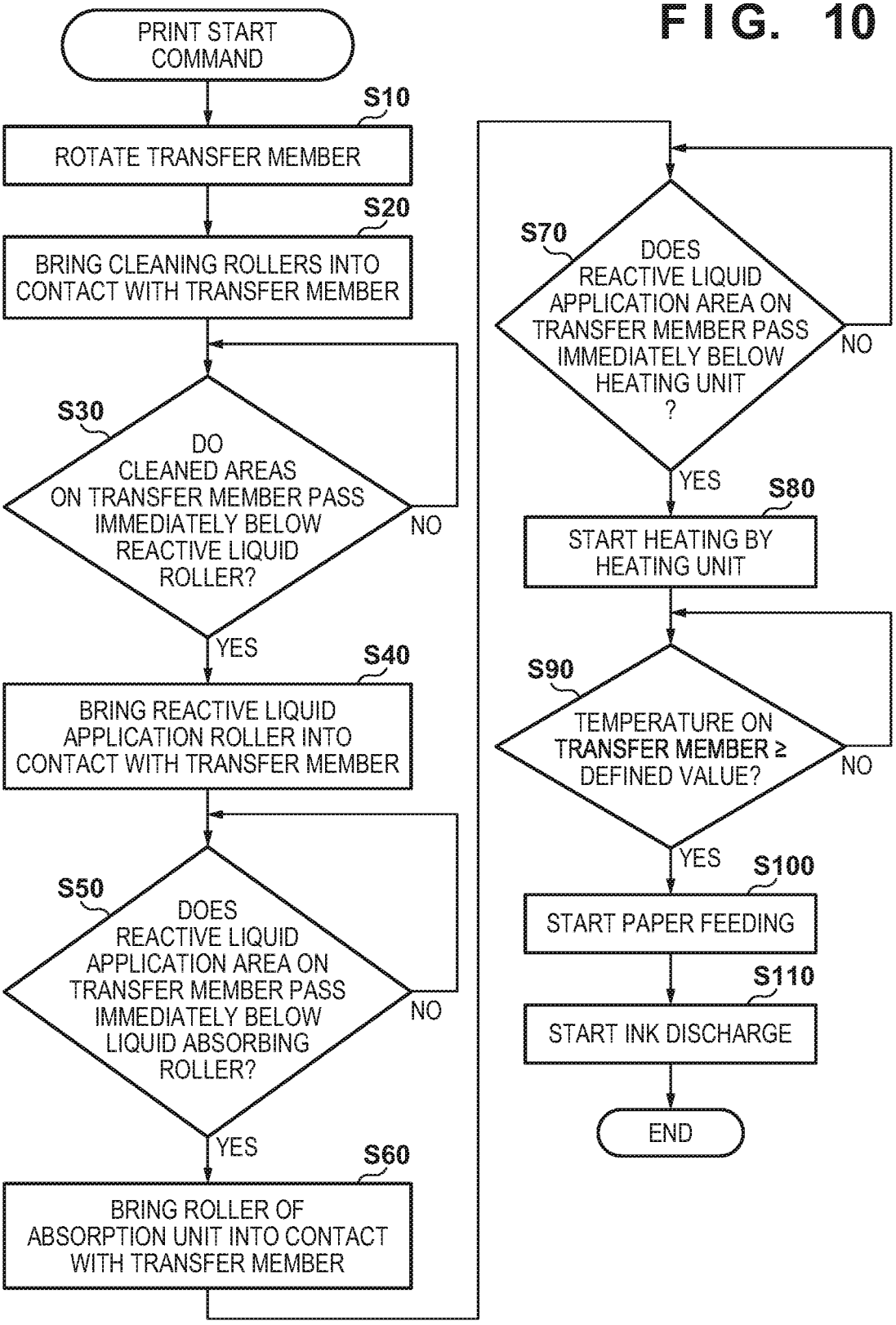
FIG. 10 is a flowchart showing the contact processing of the respective units at the start of the printing operation.

The contact processing of the respective units at the start of the printing operation (FIG. 10)

FIG. 10 is a flowchart showing the contact processing of the respective units at the start of the printing operation described with reference to FIGS. 8A to 9B.

Upon receiving a print start command, the transfer member 2 is rotated in step S10, and the rollers (cleaning rollers) of the cleaning unit 5D are first brought into contact with the transfer member 2 in step S20. Consequently, the cleaning unit 5D starts cleaning. Then, if it is confirmed in step S30 that the cleaned areas on the transfer member reach immediately below the roller of the application unit 5A in accordance with the rotation of the transfer member 2, the process advances to step S40 in which the roller (reactive liquid application roller) of the application unit 5A is brought into contact with the transfer member 2. Consequently, the application unit 5A starts applying the reactive liquid.

Subsequently, if it is confirmed in step S50 that the area to which the reactive liquid has already been applied on the transfer member reaches immediately below the roller (liquid absorbing roller) of the absorption unit 5B in accordance with the rotation of the transfer member 2, the process advances to step S60 in which the roller (reactive liquid application roller) of the absorption unit 5B is brought into contact with the transfer member 2. Consequently, the absorption unit 5B starts absorbing and collecting the liquid component of the reactive liquid.

Furthermore, if it is confirmed in step S70 that areas each in which at least the part of the liquid component of the reactive liquid is absorbed on the transfer member reach immediately below the heating unit 5C in accordance with the rotation of the transfer member 2, the process advances to step S80 in which the heating unit 5C starts heating the transfer member 2. Next, if a sensor provided around the transfer member 2 confirms in step S90 that the temperature of the transfer member 2 becomes a predetermined defined value (target value) or more, the process advances to step S100.

In step S100, a print medium (for example, a printing paper sheet) is fed from the feeding unit 7. In step S110, the printhead 30 of the print unit 3 discharges ink to the transfer member 2, starting image printing.

As described above, at the start of the printing operation, while rotating the transfer member 2, the printing system 1

(1) starts cleaning by bringing the rollers of the cleaning unit into contact with the surface of the transfer unit,
(2) starts applying the reactive liquid by bringing the roller of the application unit into contact with the cleaned areas,
(3) starts absorbing the liquid component of the reactive liquid by bringing the roller of the absorption unit into contact with the area to which the reactive liquid has already been applied, and
(4) starts image formation by the print unit after the temperature of the transfer member reaches the target value or more.

Note that heating by the heating unit is not limited to the timing described in the flowchart of FIG. 10 but may be performed at another timing.

The separation sequence of the respective units at the stop of the printing operation (FIGS. 11A to 12B)

FIGS. 11A to 12B are views each showing a sequence in which the respective units are separated from the transfer member 2 at the stop of the printing operation.

Figure 11A:
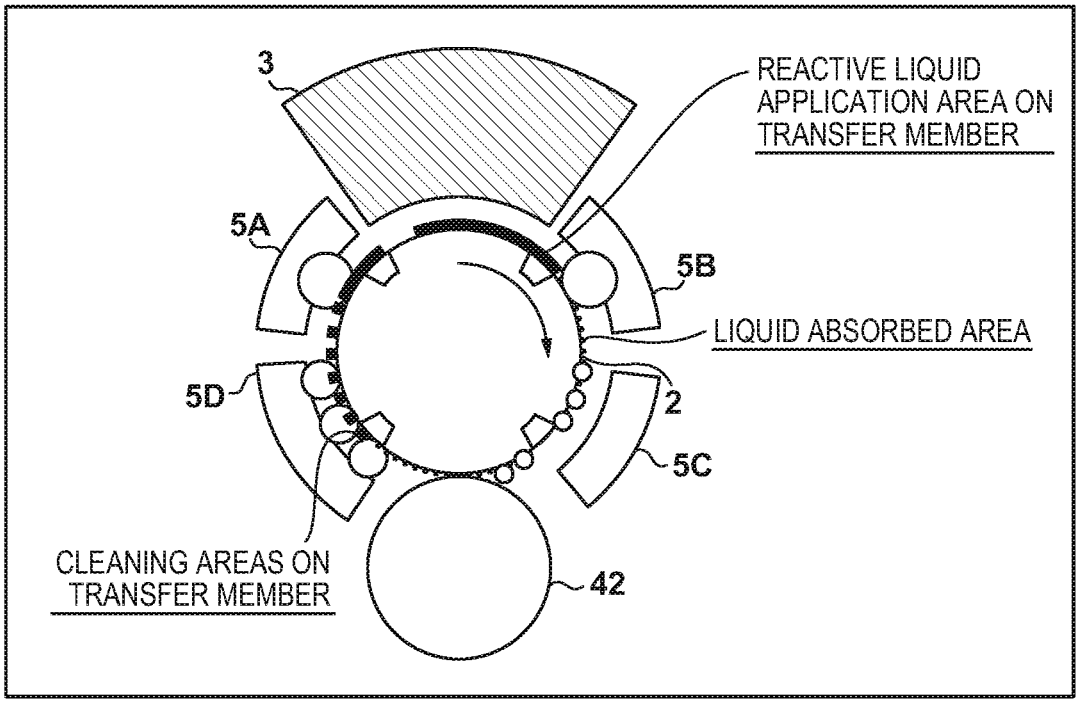
FIGS. 11A to 11B are views each showing a sequence in which the respective units are separated from the transfer member at the stop of the printing operation.

In accordance with reception of a print (image printing) stop command from the host apparatus HC1, as shown in FIG. 11A, the printing control unit 15A stops ink discharge from the printhead 30. Note that even in this case, all the peripheral units provided on the periphery of the transfer member 2 continue their operations until the formed image is transferred to the print medium entirely.

Figure 11B:
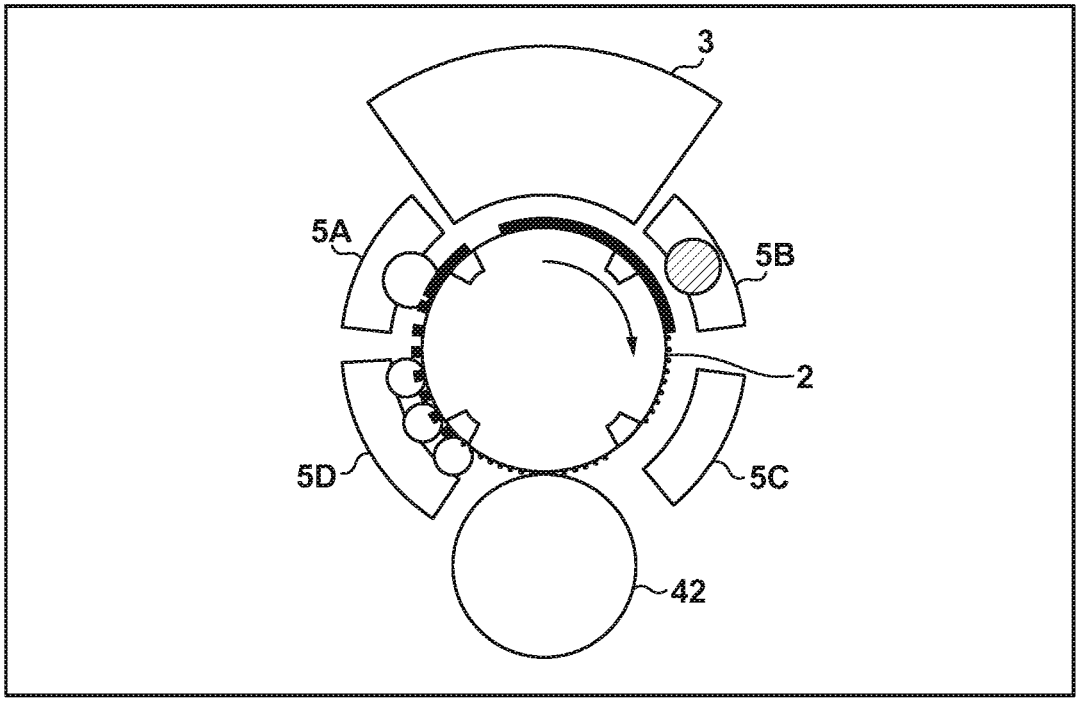

Subsequently, upon completion of the whole transfer operation of the formed image, as shown in FIG. 11B, the roller (full circle) of the absorption unit 5B is first separated from the transfer member 2, and a heating operation by the heating unit 5C is stopped.

Figure 12A:
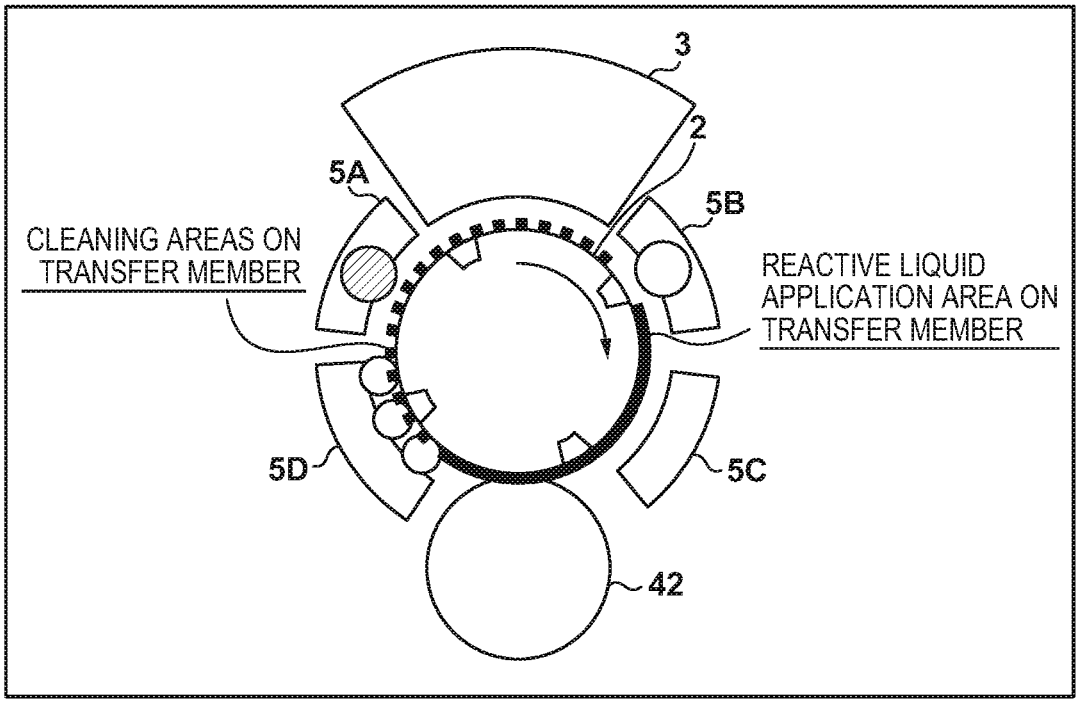
FIGS. 12A to 12B are views each showing a sequence in which the respective units are separated from the transfer member at the stop of the printing operation.
Figure 12B:
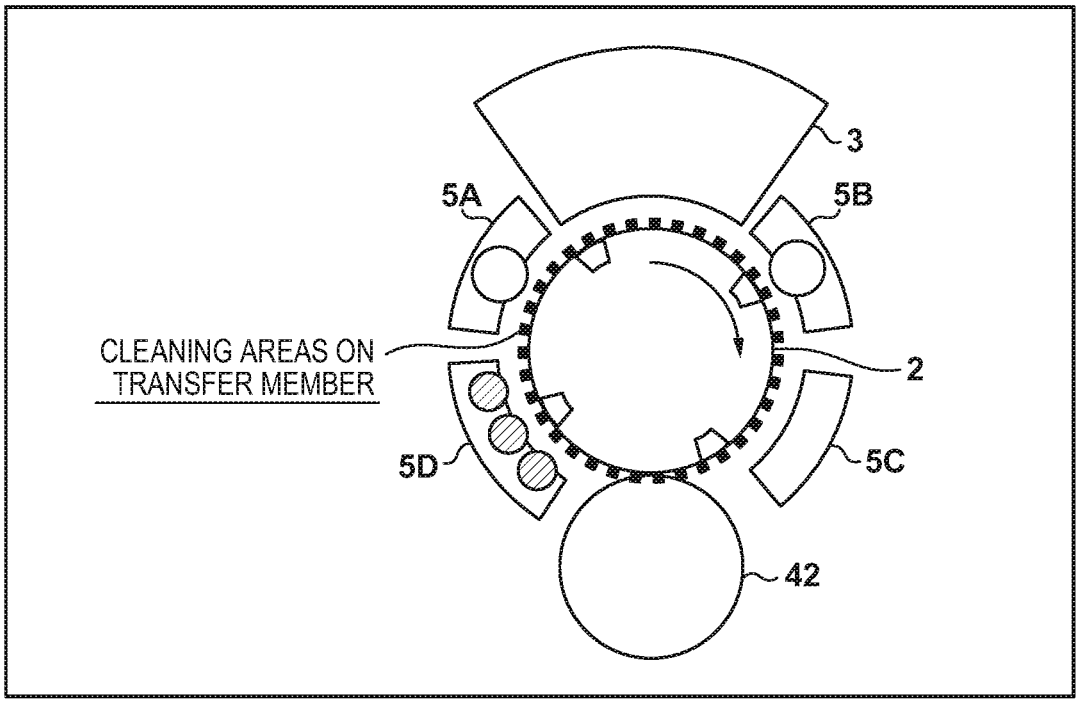

Further, as shown in FIG. 12A, the roller of the application unit 5A is separated from the transfer member 2 after the roller of the absorption unit 5B is separated. Furthermore, as shown in FIG. 12B, the rollers of the cleaning unit 5D are then separated from the transfer member 2 after the cleaning unit 5D cleans the entire area on the transfer member 2 to which the reactive liquid is applied.

Figure 13:
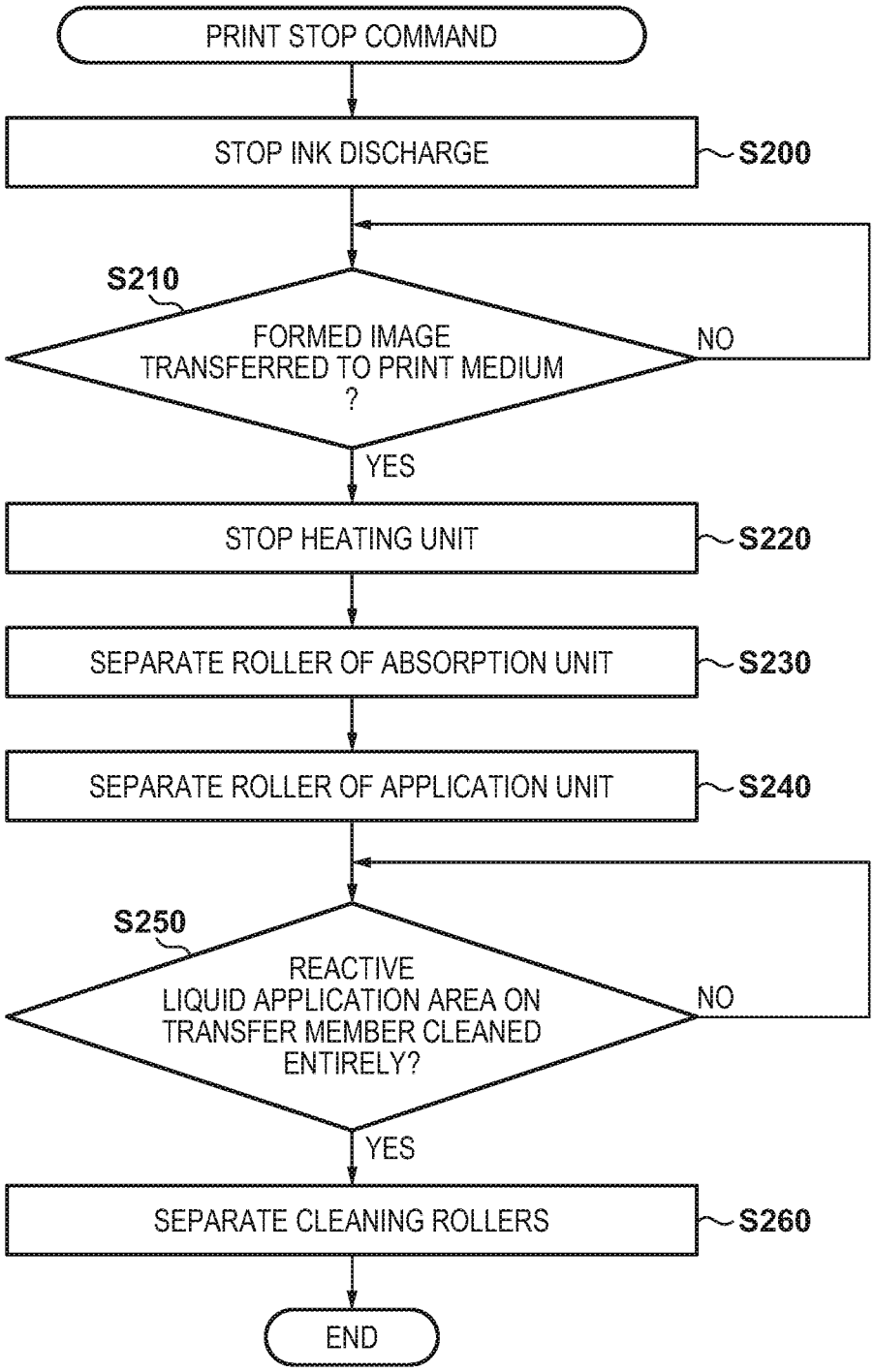
FIG. 13 is a flowchart showing the separation processing of the respective units at the stop of the printing operation.

The separation processing of the respective units at the stop of the printing operation (FIG. 13)

FIG. 13 is a flowchart showing the separation processing of the respective units at the stop of the printing operation described with reference to FIGS. 11A to 12B.

Upon receiving the print stop command, in step S200, ink discharge from the printhead 30 is stopped. Next, if it is confirmed in step S210 that the image formed on the transfer member 2 is transferred to the print medium, the process advances to step S220 in which the heating operation by the heating unit 5C is stopped.

Further, in step S230, the roller of the absorption unit 5B is first separated from the transfer member 2. Furthermore, in step S240, the roller of the application unit 5A is then separated from the transfer member 2.

Next, if it is confirmed in step S250 that the cleaning unit 5D terminates an operation of cleaning the reactive liquid, ink, and the like remaining on the transfer member 2, the process advances to step S260 in which the rollers (cleaning rollers) of the cleaning unit 5D are separated from the transfer member 2. More specifically, the transfer member 2 makes one revolution (360°) or more after the roller of the application unit 5A is separated from the transfer member 2, and then the cleaning rollers are separated from the transfer member 2. Consequently, the separation processing at the stop of the printing operation ends.

As described above, at the stop of the printing operation, while rotating the transfer member 2, the printing system 1

(1) stops ink discharge from the printhead 30, (2) stops the heating operation by the heating unit and separates the roller of the absorption unit, (3) separates the roller of the application unit, and (4) separates the rollers of the cleaning unit after the cleaning unit cleans the remaining reactive liquid and ink.

Therefore, according to the above-described embodiment, it is possible to bring the rollers of the respective units into contact with the transfer member in a proper sequence at the start of the printing operation and separate the rollers of the respective units from the transfer member in a proper sequence at the stop of the printing operation. This prevents printing from being started in a state in which dust or ink remains in the transfer member, or the transfer member remains in a dry condition. This also prevents the printing operation from being stopped in the state in which the dust or the ink remains in the transfer member. As a result, it becomes possible to perform satisfactory image printing.

Other Embodiment(s)

In the above embodiment, the print unit 3 includes the plurality of printheads 30. However, a print unit 3 may include one printhead 30. The printhead 30 may not be a full-line head but may be of a serial type that forms an ink image while scanning a carriage to which the printhead 30 is attachably mounted in a Y direction and discharging ink from the printhead 30.

A conveyance mechanism of the print medium P may adopt another method such as a method of clipping and conveying the print medium P by the pair of rollers. In the method of conveying the print medium P by the pair of rollers or the like, a roll sheet may be used as the print medium P, and a printed product P' may be formed by cutting the roll sheet after transfer.

In the above embodiment, the transfer member 2 is provided on the outer peripheral surface of the transfer drum 41. However, another method such as a method of forming a transfer member 2 into an endless swath and running it cyclically may be used.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-127833, filed Jun. 29, 2017, which is hereby incorporated by reference herein in its entirety.

What is claimed is:

1. An inkjet printing apparatus comprising:

a transfer member that rotates cyclically;

a printhead configured to discharge ink to the transfer member and print an image;

a transfer nip formed with the transfer member in which the image is transferred from the transfer member to a print medium;

a cleaner movable between a state in which the cleaner is in contact with the transfer member and a state in which the cleaner is separated from the transfer member, the cleaner being configured to clean the transfer member when in contact with the transfer member;

an applicator movable between a state in which the applicator is in contact with the transfer member and a state in which the applicator is separated from the transfer member, the applicator being configured to apply a reactive liquid that is reactive with the ink to the transfer member when in contact with the transfer member; and a controller configured to (i) bring the cleaner into contact with the transfer member from a state where the cleaner is separated from the transfer member and the applicator is separated from the transfer member and (ii) bring the applicator into contact with the transfer member after the cleaner is brought into contact with the transfer member.

2. The apparatus according to claim 1, further comprising an absorber configured to absorb a liquid component from the reactive liquid applied by the applicator in contact with the transfer member.

3. The apparatus according to claim 2, wherein the absorber is movable between a state in which the absorber is in contact with the transfer member and a state in which the absorber is separated from the transfer member and the controller is further configured to bring the absorber into contact with the transfer member after the applicator is brought into contact with the transfer member.

4. The apparatus according to claim 1, further comprising a heater configured to heat the transfer member, wherein the ink is discharged from the printhead to the transfer member after the heater heats the transfer member until a temperature of the transfer member becomes not less than a predetermined defined value.

5. The apparatus according to claim 1, wherein after the transfer member starts to rotate, the controller is configured to (i) bring the cleaner into contact with the transfer member from a state where the cleaner is separated from the transfer member and the applicator is separated from the transfer member and (ii) bring the applicator into contact with the transfer member after the cleaner is brought into contact with the transfer member.

6. The apparatus according to claim 1, wherein after receiving a print start command and before the printhead discharges ink to the transfer member, the controller is configured to (i) bring the cleaner into contact with the transfer member from a state where the cleaner is separated from the transfer member and the applicator is separated from the transfer member and (ii) bring the applicator into contact with the transfer member after the cleaner is brought into contact with the transfer member.

7. The apparatus according to claim 1, wherein after the cleaner is brought into contact with the transfer member, the controller is configured to bring the applicator into contact with the transfer member when an area of the transfer member cleaned by the cleaner reaches a position facing to the applicator in accordance with rotation of the transfer member.

8. An inkjet printing apparatus comprising:

a transfer member that rotates cyclically;

a printhead configured to discharge ink to the transfer member and print an image;

a transfer nip formed with transfer member in which the image is transferred from the transfer member to a print medium;

an applicator movable between a state in which the applicator is in contact with the transfer member and a state in which the applicator is separated from the transfer member, the applicator being configured to apply a reactive liquid that is reactive with the ink to the transfer member;

an absorber movable between a state in which the absorber is in contact with the transfer member and a state in which the absorber is separated from the transfer member, the absorber being configured to absorb a liquid component from the reactive liquid applied by the applicator to the transfer member when in contact with the transfer member; and a controller configured to (i) bring the applicator into contact with the transfer member from a state where the applicator is separated from the transfer member and the absorber is separated from the transfer member and (ii) bring the absorber into contact with the transfer member after the applicator is brought into contact with the transfer member.

9. The apparatus according to claim 8, further comprising a cleaner configured to clean the transfer member in contact with the transfer member.

10. The apparatus according to claim 9, wherein the cleaner movable between a state in which the cleaner is in contact with the transfer member and a state in which the cleaner is separated from the transfer member and the controller is further configured to bring the cleaner into contact with the transfer member before the applicator is brought into contact with the transfer member.

11. The apparatus according to claim 10, wherein the cleaner, the applicator, and the absorber are provided around the transfer member, and configured such that when the transfer member is rotated, an area of the transfer member cleaned by the cleaner reaches an area to which the reactive liquid is applied by the applicator, and furthermore, the area to which the reactive liquid is applied by the applicator reaches an area in which the absorber absorbs the liquid component of the reactive liquid.

12. The apparatus according to claim 8, further comprising a heater configured to heat the transfer member, wherein the ink is discharged from the printhead to the transfer member after the heater heats the transfer member until a temperature of the transfer member becomes not less than a predetermined defined value.

13. The apparatus according to claim 8, wherein after the transfer member starts to rotate, the controller is configured to (i) bring the applicator into contact with the transfer member from a state where the applicator is separated from the transfer member and the absorber is separated from the transfer member and (ii) bring the absorber into contact with the transfer member after the applicator is brought into contact with the transfer member.

14. The apparatus according to claim 8, wherein after receiving a print start command and before the printhead discharges ink to the transfer member, the controller is configured to (i) bring the applicator into contact with the transfer member from a state where the applicator is separated from the transfer member and the absorber is separated from the transfer member and (ii) bring the absorber into contact with the transfer member after the applicator is brought into contact with the transfer member.

15. The apparatus according to claim 8, wherein after the applicator is brought into contact with the transfer member, the controller is configured to bring the absorber into contact with the transfer member when an area of the transfer member to which the applicator applies the reactive liquid reaches a position facing to the absorber in accordance with rotation of the transfer member.

* * * * *